United States Patent [19]

Baranescu

[11] Patent Number: 4,913,113

[45] Date of Patent: Apr. 3, 1990

[54] INTERNAL COMBUSTION ENGINE WITH FUEL TOLERANCE AND LOW EMISSIONS

[76] Inventor: George S. Baranescu, 5316 Howard Ave., Western Springs, Ill. 60558

[21] Appl. No.: 294,762

[22] Filed: Jan. 9, 1989

[51] Int. Cl.[4] ..... F02M 39/00

[52] U.S. Cl. ..... 123/300; 123/447

[58] Field of Search ..... 123/299, 300, 447, 446, 123/458; 239/88, 89, 90, 91, 92, 93, 94, 95, 96

[56] References Cited

U.S. PATENT DOCUMENTS

| | | | |
|---|---|---|---|
| 3,391,871 | 7/1968 | Fleischer | 123/299 |
| 4,528,951 | 7/1985 | Yamada | 123/300 |
| 4,612,893 | 9/1986 | Ishibashi | 123/447 |
| 4,705,010 | 11/1987 | Baranescu | 123/300 |
| 4,754,733 | 7/1988 | Steiger | 123/299 |
| 4,796,577 | 1/1989 | Baranescu | 123/300 |
| 4,811,715 | 3/1989 | Djorpjeuic | 123/447 |
| 4,811,899 | 3/1989 | Egler | 123/299 |
| 4,825,842 | 5/1989 | Steiger | 123/447 |
| 4,831,982 | 5/1989 | Baranescu | 123/300 |

FOREIGN PATENT DOCUMENTS

| | | | |
|---|---|---|---|
| 3807965 | 10/1988 | Fed. Rep. of Germany | 123/299 |

*Primary Examiner*—Carl Stuart Miller

[57] ABSTRACT

An internal combustion engine operating with fuel injection, the fuel charge of each cylinder of the engine being divided in two or three portions of different amount, injected sequentially starting with a portion of small amount. The portions of the fuel charge are injected through the same injector in the same combustion chamber. The smaller portions of the fuel charge are accumulated in the injector. The accumulation occurs during the injection of the larger portion of the fuel charge. The accumulated fuel is injected in the next cycle by fuel expansion. When the fuel charge is divided in three portions the large portion of the fuel charge is preceded and followed by small portions.

11 Claims, 7 Drawing Sheets

INTERNAL COMBUSTION ENGINE WITH FUEL TOLERANCE AND LOW EMISSIONS

The invention relates to an internal combustion engine having the capacity to operate with a variety of fuels and to generate low emissions, using one fuel at a time.

Several methods have been proposed for achieving fuel tolerance of internal combustion engines using one fuel at a time. These methods, which mostly refer to diesel engines, use spark assistance, ignition on a hot surface, the increase of air temperature at the time of fuel injection, and ignition by a flame jet. The engines operating according to these methods are either not practical or do not achieve a large fuel tolerance.

The object of the invention as described and claimed further is to provide an internal combustion engine of simple design, which can operate with a range of fuels, and generate low emissions. Each cylinder of the engine includes an open combustion chamber provided with an injector connected to a fuel injection system, as well as with a glow plug and a spark plug.

The fuel charge of every cycle is divided in two, eventually in three portions of different amount, which are injected sequentially through the same injector into the open combustion chamber, at selected timings. The fuel injection starts with a small portion of the fuel charge which is electrically ignited. Then follows the injection of the main portion of the fuel charge, which is achieved by the injection pump in conventional way; this portion of the fuel charge is ignited by the burning gases generated by the combustion of the small portion of the fuel charge previously injected. When the fuel charge is divided in three portions, the third portion is injected into open combustion chamber after the injection of the large portion of the fuel charge.

All portions of the fuel charge are achieved by the same injection pump. The small portions of the fuel charge are accumulated in the injector during the injection of the main portion of the fuel charge, and the injection of the accumulated portions is achieved by fuel expansion. The injection timing and the amount of the small portions of the fuel charge are controlled by valves. The injection timing and the amount of the main portion of the fuel charge are controlled by the injection pump. Further, the small portions of the fuel charge are called pilots.

The manner in which the invention is carried into practice, the methods of operation, and further objects and advantages of the invention are set forth in the following specification, wherein the invention is described in further detail by reference to the accompanying drawing.

Figure 1:
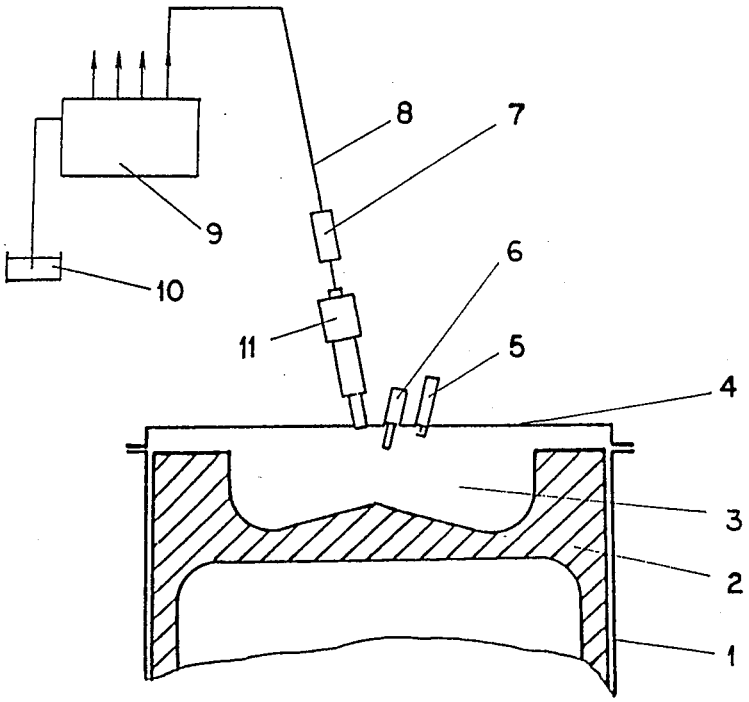
FIG. 1 shows in a schematic way the general configuration of the engine according to the invention.

The general configuration of the engine is shown in FIG. 1 where only one cylinder have been represented. The engine includes cylinder 1, piston 2 wherein as an example the open combustion chamber 3 is located, cylinder head 4 provided with the spark plug 5, and the glow plug 6. The spark plug 5 is connected to a spark ignition system, and the glow plug 6 to a source of electricity. These connections are not represented in FIG. 1. The injector 11 of a new design is connected to the injection pump 9 by the high pressure line 8 provided with heater 7. The injection pump 9 is connected to the fuel tank 10. The other usual components of the engine are not represented in FIG. 1.

Figure 2:
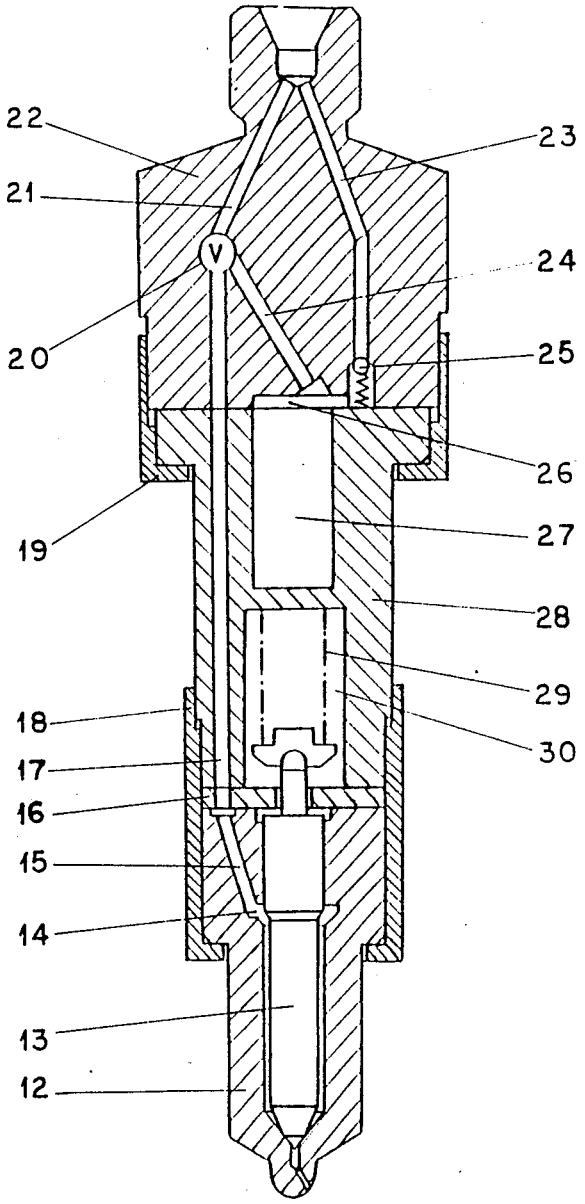
FIG. 2 represents an embodiment of the injector which includes a 3-way electromagnetic valve located on high pressure channel of the injector, and connected with the accumulator.

One embodiment of the injector 11 is represented in FIG. 2. The injector is provided with a conventional nozzle, which includes the body 12, and nozzle needle 13 actuated by spring 29 located in barrel 28. The nozzle needle lift is limited by the disc 16. The injector includes the accumulator 27 located in barrel 28. The accumulator 27 is connected with the upper section 21 of high pressure channel of the injector via channel 26 and one-way check valve 25, and channel 23, as well as with the chamber 14 of the nozzle 12 via channels 26 and 24, 3-way electromagnetic valve 20, the lower section 17 of high pressure channel of the injector, and channel 15. The 3-way electromagnetic valve 20 can connect the lower section 17 of high pressure channel either to upper section 21 of this channel, or to channel 24. The fuel leakage between nozzle needle 13 and nozzle body 12 is collected in the room 30 of spring 29 and drained through a channel which is not represented in FIG. 2. The nozzle body 12, disk 16, and barrel 28 are assembled by the retaining nut 18, and barrel 28 is assembled with the upper part 22 by the retaining nut 19.

The engine operates as follows. Before the start of fuel injection into open combustion chamber 3 (FIG. 1) the fuel pressure in the accumulator 27 and channels 26 and 24 is higher than the opening pressure of nozzle needle 13. The electromagnetic valve 20 is switched in the position wherein channels 17 and 21 are connected and channel 24 is closed. The fuel pressure downstream from this valve is the residual pressure in high pressure line 8 (FIG. 1).

When the injection of the first pilot shall start, the electromagnetic valve 20 is switched in the position wherein channel 21 is closed and channels 17 and 24 are connected. As a result the accumulator 27 discharges into channel 17, the fuel pressure in nozzle chamber 14 increases, the nozzle needle 13 opens, and the injection of the first pilot starts. At a selected moment the electromagnetic valve 20 is switched in the position wherein channel 24 is closed and channels 17 and 21 are connected. Consequently the nozzle chamber 14 discharges into high pressure line 8 (FIG. 1) via channels 15 and 17, 3-way electromagnetic valve 20, and channel 21, which generate a fast closing of the nozzle.

To achieve the injection of the pilot as described above, the amount of fuel which flows from the accumulator shall increase the pressure downstream from the accumulator at least up to the opening pressure of the nozzle needle 13. Therefore accumulator shall be large enough to satisfy this condition, even for the operating conditions wherein the pressure in the accumulator is the lowest.

The start of the injection of first pilot can be modified in large limits because the 3-way electromagnetic valve 20 can open channel 24 at any time between the closing of the exhaust valve and late compression stroke. The amount of the first pilot is controlled by the closing timing of channel 24 achieved by the electromagnetic valve 20.

The possibility to inject the first pilot as early as necessary, the fine atomization of the fuel achieved by high pressure injection, the high temperature in the combustion chamber, as well as the support brought by the glow plug ensures an advanced vaporization of first pilot for a large range of fuels. The vaporized fuel mixes with the air of combustion chamber 3 (FIG. 1) and this mixture is then spark ignited.

At a selected moment during the combustion of the first pilot the injection pump 9 (FIG. 1) starts to deliver fuel towards the injector. Because at that time the two sections 17 and 21 of the high pressure channel (FIG. 2) are connected by the 3-way electromagnetic valve 20 of the main portion of the fuel charge is injected into combustion chamber as by a conventional injector. A fast ignition and a smooth combustion occur whichever is the self-ignition property of the used fuel because: (1) the combustion of first pilot has substantially increased the temperature and pressure in combustion chamber; (2) the radiation and the high temperature of the burning gases generated by the combustion of first pilot produce a fast vaporization of the injected fuel; (3) the burning gases generated by the combustion of first pilot have high concentration of reactive particles, which accelerate and even shorten the chain reactions on which the ignition and combustion of the respective fuel proceed.

If necessary, a second pilot can be injected into combustion chamber after the injection of the large portion of the fuel charge by another opening/closing of channel 24. The second pilot may improve the engine performance when slow burning fuels are used. The operation of the engine with two pilots requres a larger accumulator.

The accumulation of the fuel necessary to achieve the injection of the pilots occurs during the injection of the main portion of fuel charge. Because channel 23 (FIG. 2) is in open connection with high pressure line 8 (FIG. 1), the fuel pressure in channel 23 increases when the injection pump delivers fuel into high pressure line 8. When the fuel pressure in channel 23 becomes higher than the residual pressure in accumulator 27 the one-way check valve 25 opens and fuel from channel 23 flows into accumulator 27 via channel 26. After the fuel pressure in line 8 has reached the maximum for the respective cycle of the engine, the fuel pressure in channel 23 decreases, the one-way check valve 25 closes, and therefore the accumulation of the fuel ends.

When the engine operates with two pilots the first discharge of the accumulator occurs in the cycle wherein the fuel is accumulated, for achieving the second pilot. The second discharge of the accumulator occurs in the next cycle, for achieving the first pilot of that cycle.

The control of the timing and amount of pilots by the electromagnetic valve 20 requires a very fast acting valve, because the amount of each pilot is small and consequently the period of time wherein the pilot is injected is very short. This inconvenience can be lowered to some extent by using the electromagnetic valve 20 only for the control of the start of accumulator discharge towards the nozzle. The 3-way electromagnetic valve 20 remains open for a period of time longer than the duration of pilot injection. In this case the injection of the pilot ends when the fuel pressure in the accumulator and in the volume downstream from the accumulator becomes lower but near the closing pressure of the injector.

In this second mode of operation of the 3-way electromagnetic valve 20 only one of the two pilots can be delivered, because at the end of the accumulator discharge the fuel pressure in accumulator is lower than the opening pressure of the injector Consequently no other discharge of the accumulator is possible. The only discharge of the accumulator shall be used for the delivery of the first pilot, which is of essential importance for engine operation. The 3-way electromagnetic valve 20 shall be switched in the position wherein channel 24 is closed before the injection pump starts to deliver fuel towards the injector.

The second mode of operation of the electromagnetic valve 20 does not allow the control of the pilot amount. The pilot amount depends on the size of the accumulator, and of the maximum fuel pressure of the injection cycle; the higher the maximum fuel pressure of the injection cycle, the higher the amount of pilot.

For some applications, the amount of first pilot delivered by the injector of FIG. 2 in the second mode of operation of the 3-way electromagnetic valve 20 may be too large at high load and/or speed. To prevent this situation a control of the amount of first pilot shall be provided. Such control can be achieved in several ways: (1) by limiting the amount of fuel which flows into accumulator 27; (2) by draining a portion of the accumulated fuel before the start of injection of first pilot; (3) by allowing only a partial discharge of the accumulator 27 towards the nozzle 12.

Figure 3:
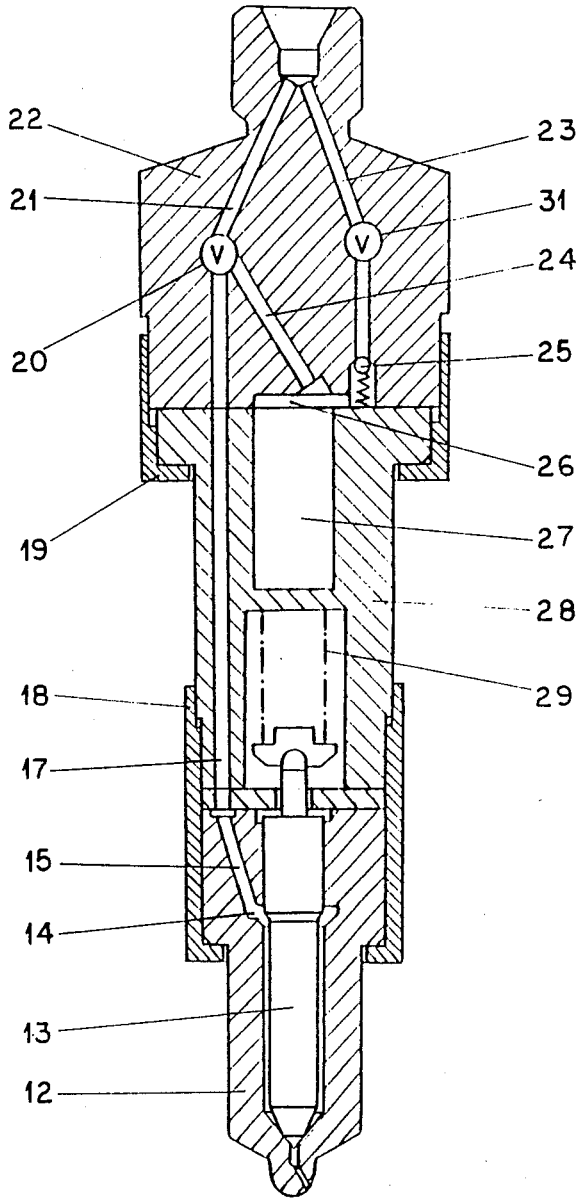
FIG. 3 represents the injector of FIG. 2 provided with a valve which controls the amount of fuel flowing into accumulator.

The limitation of the amount of fuel which flows into accumulator 27 can be achieved by providing a control on channel 23 (FIG. 2). As an example a 2-way electromagnetic valve 31 located on this channel can be used (FIG. 3). This valve is opened before the injection pump 9 starts to deliver fuel into line 8 (FIG. 1). When the selected amount of fuel has flown into accumulator 27, the electromagnetic valve 31 is closed. A slow acting electromagnetic valve 31 can be used, because almost the duration of an engine cycle is available to open again this valve.

Figure 4:
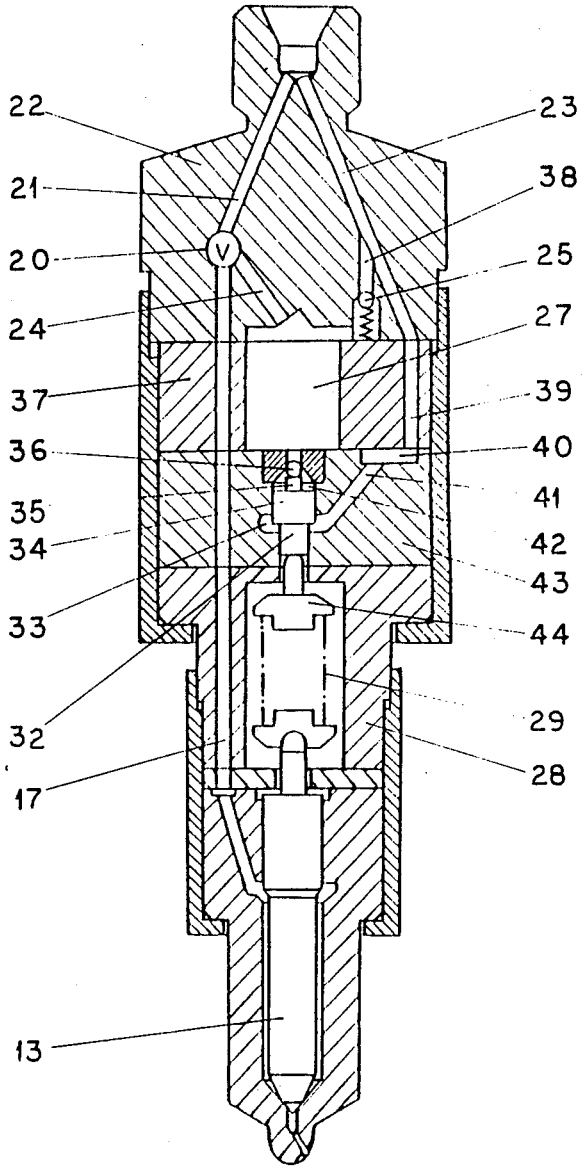
FIG. 4 represents an embodiment of the injector of FIG. 2 provided with a valve which controls the fuel pressure in the accumulator.

The drain of a portion of the accumulated fuel can be achieved by providing the accumulator 27 with a pressure control valve, as shown in FIG. 4 wherein, as an example, a hydro-mechanical pressure control valve was considered. The injector has all the components of the injector of FIG. 2. Additionally the injector of FIG. 4 includes barrel 43 in which the pressure control valve 36 is located. This valve is actuated by the spring 29 of the nozzle needle 13. The spring force is transmitted to valve 36 by the spring support 44, which acts on pistons 32 and 34 forming together one piece, and by the cylindrical portion 35 of piston 34. Chamber 33 is connected to channel 23 via channels 41, 40 and 39. Chamber 42 is drained by a channel which is not represented in FIG. 4. The accumulator 27 is directly connected to pressure control valve 36. The one-way check valve 25 is connected to channel 23 via channel 38.

The accumulation of the fuel charge occurs as described in connection with FIG. 2. During the injection of the main portion of fuel charge valve 36 remains closed whichever is the pressure in the accumulator 27, because the fuel pressure in chamber 33 is equal to fuel pressure in channel 23. Conseqently the pressure control valve 36 is maintained on its seat by the force of spring 29 and the force generated on piston 34 by the fuel pressure in chamber 33. After the end of injection of the main portion of fuel charge the pressure in channel 23 as well as in chamber 33 decreases to the residual pressure in high pressure line 8 (FIG. 1). Valve 36 opens and a portion of the fuel of the accumulator 27 is drained via chamber 42. This portion depends on the residual pressure in chamber 33, therefore on load and speed; the higher the load and speed, the higher the residual pressure, and consequently the smaller the discharge of the accumulator.

Thus, the injector of FIG. 4 achieves a first pilot whose amount increases with load and speed, as the injector of FIG. 2 does. However, the increase of the first pilot is attenuated by the partial discharge of the accumulator 27 achieved by the pressure control valve 36. The attenuation can be controlled by a corresponding selection of the diameters of pistons 34 and 32, and the diameter of the channel controlled by the valve 36.

The injector of FIG. 4 delivers a first pilot of constant amount if the high pressure section of the injection system is connected to the fuel tank 10 (FIG. 1) between consecutive injections. In this case the residual pressure in line 8 is the same at any operating regime of the engine. Therefore the pressure in the accumulator 27 at the end of the discharge into chamber 42 is always the same, because this pressure depends only on the force of spring 29, the force generated by the fuel pressure in chamber 33, and on the diameter of the channel controlled by the valve 36. All these parameters are constant. Thus, the injector delivers a first pilot of constant amount at any operating conditions. For a given spring 29, the amount of the first pilot can be tailored by selecting the volume of the accumulator 27 and the diameter of the channel controlled by the valve 36.

The connection of high pressure section of the injection system to the fuel tank 10 (FIG. 1) can be achieved through a derivation controlled by a valve whose operation is electronically programmed, or through and controlled by the injection pump. The connection through a derivation allows the operation of the injector of FIG. 4 with a first pilot of constant or variable amount, as the high pressure section of the injection system is/is not connected to the fuel tank 10 between consecutive injections, respectively.

The partial discharge of the accumulator towards the nozzle can be achieved by providing an additional control on the connection between the accumulator 27 and nozzle chamber 14.

Figure 5:
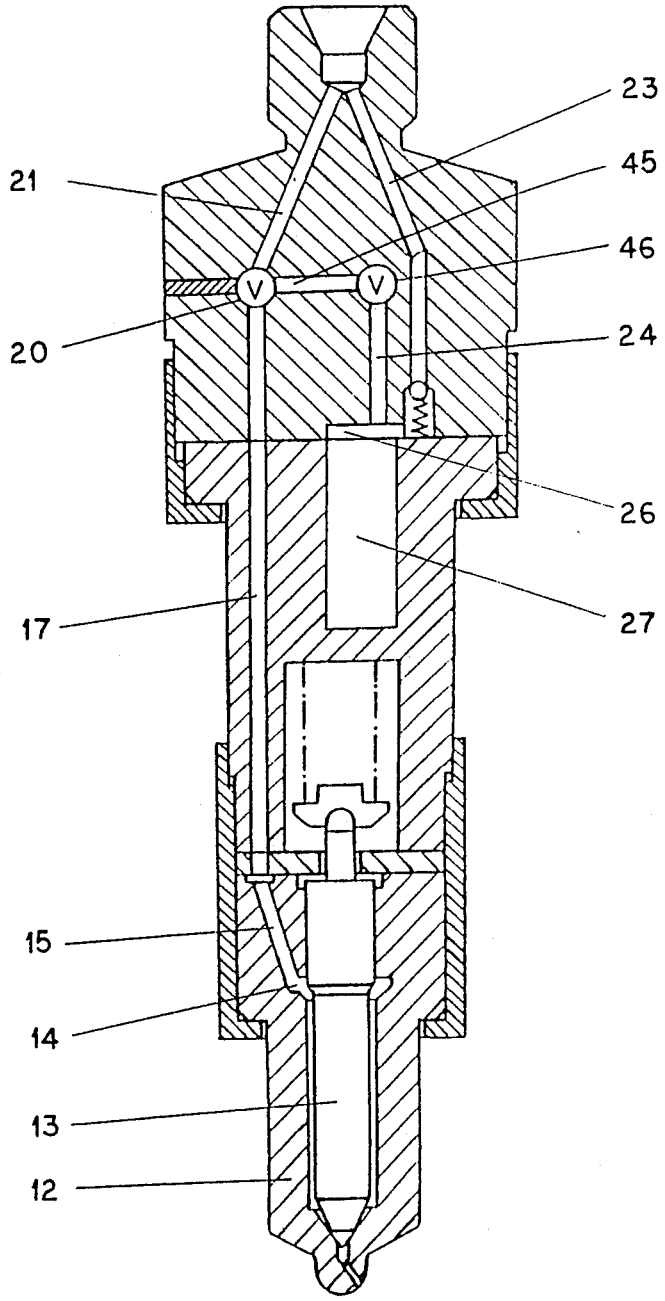
FIG. 5 represents an embodiment of the injector wherein the discharge of the accumulator towards the nozzle chamber is controlled by a 2-way and a 3-way electromagnetic valve, the high pressure channel of the injector being connected to nozzle chamber through the 3-way electromagnetic valve.

One example of such configuration is shown in FIG. 5 which represents the injector of FIG. 2 wherein the connection between the the accumulator 27 and 3-way electromagnetic valve 20 is achieved via channels 26 and 24, 2-way electromagnetic valve 46, and channel 45.

Before the discharge of the accumulator 27 towards the nozzle chamber 14, the 2-way electromagnetic valve 46 is closed, and the 3-way electromagnetic valve 20 is switched in the position wherein channel 21 is closed and channels 45 and 17 are connected. To start the discharge of the accumulator 27 towards the nozzle chamber 14 the electromagnetic valve 46 is opened. To end the discharge of the accumulator towards the nozzle chamber 14 the electromagnetic valve 20 is switched in the position wherein channel 45 is closed and channels 17 and 21 are connected. The 3-way electromagnetic valve 20 is maintained in this position until the next cycle. As a result the nozzle chamber 14 discharges into high pressure line 8 (FIG. 1) via channels 15, 17, 3-way electromagnetic valve 20, and channel 21. When the injection pump 9 delivers fuel into high pressure line 8, the injection of the main portion of the fuel charge occurs, because channels 21 and 17 are connected. After this injection is completed, chamber 14 discharges again into high pressure line 8.

When the engine operates with one pilot the electomagnetic valves of the injector of FIG. 5 can be of slow acting type, because almost the duration of an engine cycle is available to switch the electromagnetic valves back in the initial positions. To avoid a premature discharge of the accumulator 27 towards the nozzle chamber 14, first the 2-way electomagnetic valve 46 is closed, and then the 3-way electromagnetic valve 20 is switched in the position wherein channel 21 is closed and channels 45 and 17 are connected.

Figure 6:
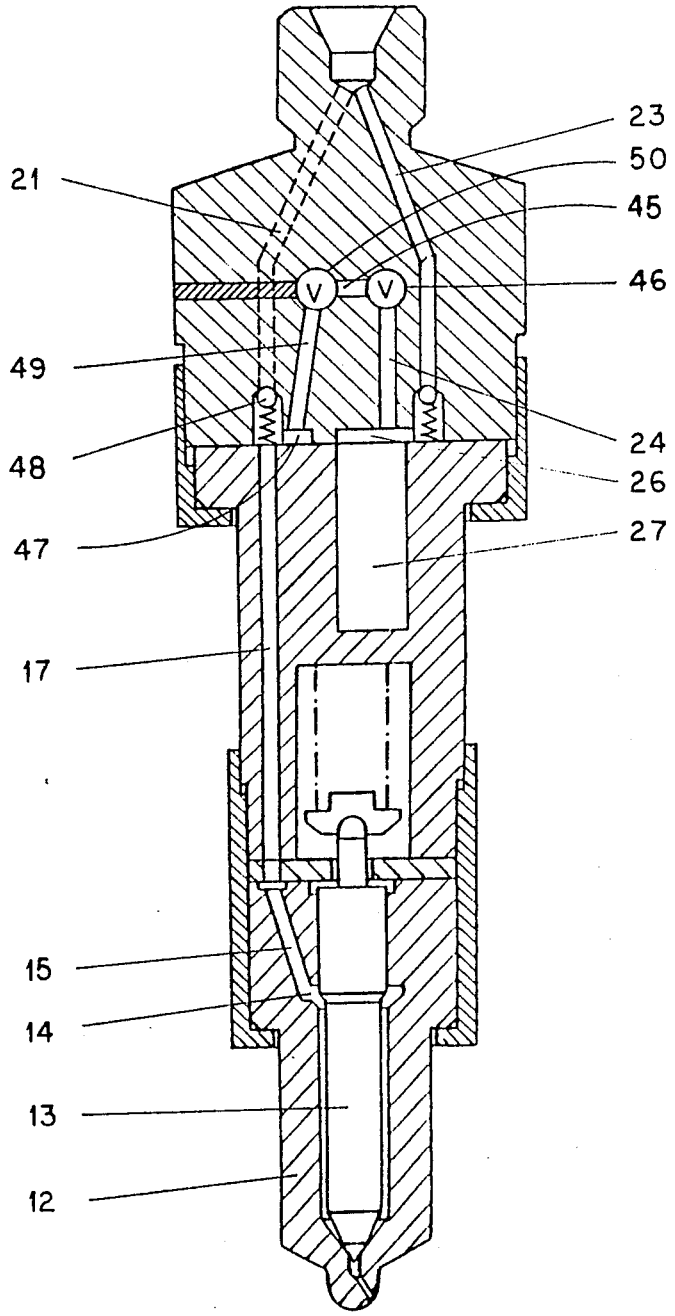
FIG. 6 represents an embodiment of the injector wherein the discharge of the accumulator towards the nozzle chamber is controlled by two 2-way electromagnetic valves, the high pressure channel of the injector being connected to nozzle chamber through a one-way check valve.

FIG. 6 shows a variant of the injector of FIG. 5. The 3-way electromagnetic valve 20 is eliminated. The connection of the accumulator 27 to nozzle chamber 14 is achieved via channels 26 and 24, 2-way electromagnetic valve 46, channel 45, 2-way electromagnetic valve 50, and channels 49, 47, 17 and 15. The two sections 21 and 17 of high pressure channel of the injector are connected by one-way check valve 48.

Before the start of injection of first pilot, the 2-way electromagnetic valve 46 is closed and the 2-way electromagnetic valve 50 is open. To start the discharge of the accumulator 27 towards nozzle chamber 14, the 2-way electromagnetic valve 46 is opened. To end the discharge of the accumulator 27 towards nozzle chamber 14, the 2-way electromagnetic valve 50 is closed. The earlier the closing of the 2-way electromagnetic valve 50, the smaller the discharge of the accumulator, and therefore the smaller the amount of first pilot. The amount of first pilot can be tailored by a corresponding selection of the closing timing of the electromagnetic valve 50.

The injector of FIG. 6 can operate as described by using slow acting electromagnetic valves 46 and 50, because almost the duration of an entire engine cycle is available for switching the electromagnetic valves back in the initial positions.

To prevent a premature discharge of the accumulator 27 towards nozzle chamber 14 first the electromagnetic valve 46 is closed, and then the electromagnetic valve 50 is opened.

In the injector of FIG. 6 the discharge of the nozzle chamber 14 at the end of each injection is prevented by the one-way check valve 48. Therefore each injection ends by the expansion of the fuel included in the volume downstream from one-way check valve 48. The discharge of nozzle chamber 14 at the end of injection of the main portion of fuel charge can be achieved by substituting the one-way check valve 48 with a poppet valve provided with retraction piston.

The injector of FIG. 5 can operate in a way which decreases the emissions of the engine at low load and idle. For this purpose the accumulator is provided with a pressure relief valve designed to open at a selected high pressure. The pressure relief valve 52 (FIG. 7) controls the connection 51 between the accumulator 27 and the injector drain via chamber 30 of injector needle spring 29. At medium and high load the injector of FIG. 7 operates as the injector of FIG. 5. At low load and idle the injection pump is set to deliver a high amount of fuel, the delivery being advanced so that the injection pump ends the fuel delivery towards the nozzle before the start of the injection of first pilot. During the fuel delivery by the injection pump, the 2-way electromagnetic valve 46 is closed and the 3-way electromagnetic valve 20 is switched in the position wherein channels 17 and 45 are connected and channel 21 is closed. Consequently all the fuel delivered by the injection pump penetrates into accumulator 27. The pressure in the accumulator increases until it becomes equal to opening pressure of valve 52. The further fuel penetration in the accumulator 27 determines the drain from the accumulator of an equal amount of fuel.

To start the fuel injection the 2-way electromagnetic valve 46 is opened. To stop the fuel injection the 3-way electromagnetic valve 20 is switched in the position wherein channel 45 is closed, and channel 17 is connected to channel 21, which allows the discharge of the nozzle chamber 14 towards the high pressure line 8 (FIG. 1).

The described mode of operation ensures high injection pressure at low load and idle. The fuel atomization is considerably improved which decreases the engine emission. The injection pressure can be controlled by a corresponding setting of the injection pump load, and by a corresponding design of valve 52.

Figure 7:
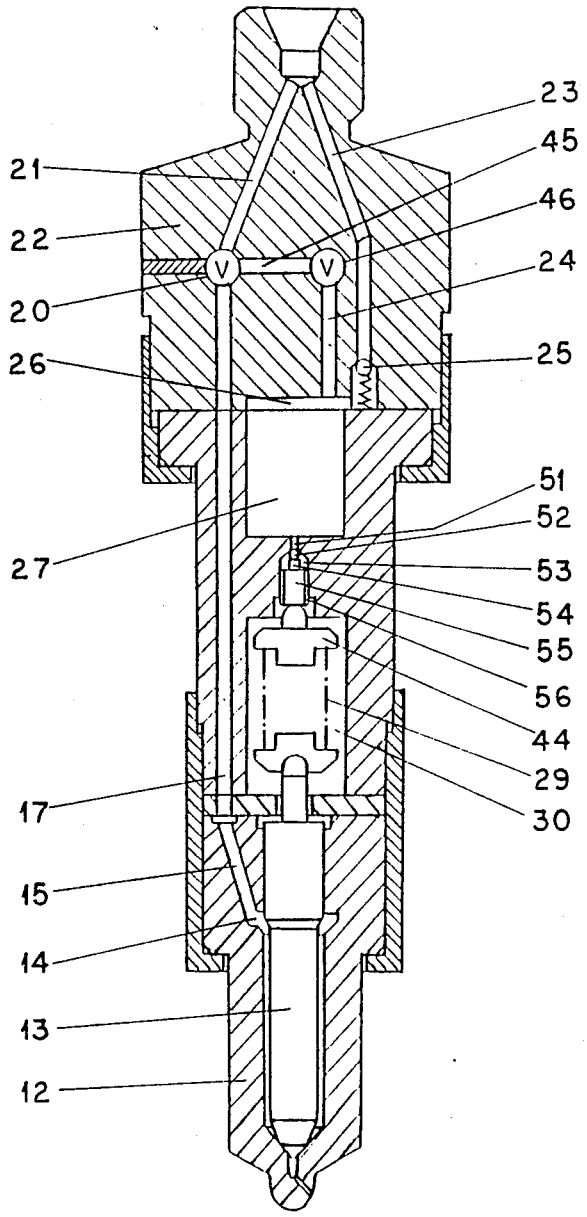
FIG. 7 represents the injector of FIG. 5 provided with a pressure relief valve which limits the maximum pressure into accumulator.

The injector of FIG. 7 can precede the injection of the large portion of the fuel charge with a fuel pilot. Before the injection pump starts to deliver fuel towards the nozzle the electromagnetic valve 20 is switched in the position wherein channel 45 is closed and channels 17 and 21 are connected. When the injection pump delivers fuel into high pressure line 8 (FIG. 1) the pressure in nozzle chamber 14 increases, the nozzle opens and the injection of the pilot starts. To end this injection the 3-way electromagnetic valve 20 is switched in the position wherein channels 17 and 45 are connected, and channel 21 is closed. The amount of fuel further delivered by the injection pump produces the penetration into accumulator of an equal amount of fuel. The injection of the main portion of the fuel charge is achieved by the accumulator as previosuly described. In this mode of operation the pilot is achieved by the injection pump which controls the timing of the pilot. The amount of pilot is controlled by the 3-way electromagnetic valve 20.

The injectors of FIGS. 5–7 can deliver two pilots by discharging the accumulator twice during the same engine cycle. The first discharge of the accumulator occurs as described, before the injection of the large portion of the fuel charge. The second discharge of the accumulator occurs after the injection of the main portion of the fuel charge. As an example the operation of these valves for the injector of FIG. 6 is further described. Before the start of the discharge of the accumulator which precedes the injection of the main portion of the fuel charge the 2-way electromagnetic valve 46 is closed, and the 2-way electromagnetic valve 50 is opened. To start the first discharge of the accumulator towards the nozzle valve 46 is opened. To end this discharge valve 56 is closed. To start the second discharge of the accumulator valve 50 is opened, and to end this discharge valve 46 is closed. To achieve such operation the volume of the accumulator shall be correspondingly increased.

When two pilots are injected the electromagnetic valves which control the discharge of the accumulator shall be of fast acting type, because the period of time between the first and the second actuation of each of these valves is short.

To optimize the engine operation over the speed and load range, as well as according to the characteristics of the used fuels, the electromagnetic valves of the embodiments of FIGS. 2–7 are electronically programmed.

In the injectors of FIGS. 2–7 the channels have been represented with their axes situated in the same plane, for description purpose. Actually the channels shall have the locations which better satisfy the requirements of injector design.

The internal combustion engine according to the invention has significant advantages.

The engine is fuel tolerant because the first pilot can be delivered with an advance so that at the time when the large portion of the fuel charge is injected burning zones are created in the combustion chamber by the combustion of the first pilot.

The combustion system decreases significantly engine emission for the following main reasons; (1) the ignition delay of the large portion of the fuel charge is short and therefore it is not necessary a trade-off of the injection timing of this portion in order to moderate the emission of nitrogen oxides; (2) the combustion of the large portion of the fuel charge is strongly supported by the first pilot; (3) at low load the engine can inject the main portion of the fuel charge at high pressure; (4) the second pilot favors a more complete oxidation of hydrocarbons and particulatles.

The smooth combustion of the larger portion of the fuel charge reduces substantially the combustion noise, and improves the mechanical efficiency. The engine has easy cold start because the combustion starts by spark ignition and not by self-ignition. The manufacturing of the engine does not require new technologies of factory retooling.

The foregoing specification of the invention has been referred to some configurations and methods of operation, it being understood that many other configurations and methods of operation are possible within the essence and the scope of the invention.

I claim:

1. An internal combustion engine including at least one cylinder, said internal combustion engine including an injection pump connected to injectors and to a fuel tank, each injector including a high pressure channel through which fuel penetrates into the injector, and a nozzle provided with a chamber and a deliver channel which is opened and closed by a valve actuated by a nozzle spring, each injector including also a drain, the combustion chamber of each cylinder being also provided with a spark plug connected to a spark ignition system and with a glow plug connected to a source electricity, the internal combustion engine including also means for fuel heating prior to fuel injection, said internal combustion engine being characterized by the capacity to divide the fuel charge of each cycle in two or three portions of different amount, according to the requirements of engine operation, and to inject these portions in a selected order and at selected timings using only one injection pump, the portions of the fuel charge including a main portion, which is injected preceeded, and, when the engine requires so, followed by small fuel portions, the small portions of the fuel charge being accumulated in the injector, the accumulation occurring during the injection of the larger portion of the fuel charge achieved by the injection pump, the accumulated fuel being injected by fuel expansion, the small portion of the fuel charge which is injected before the large portion of the fuel charge vaporizes and mixes with air in the combustion chamber, and then the fuel-air mixture is spark ignited, the larger portion of the fuel charge being injected into the burning gases generated during the combustion of the small portion of the fuel charge previously injected, the second small portion of fuel being injected, when necessary, after the injection of the large portion of the fuel charge, the accumulation, injection, and the control of the small portions of the fuel charge being achieved by providing the injector with means including an accumulator connected with high pressure channel and with the nozzle chamber, means which prevents the discharge of the accumulator into high pressure channel, means which control the timing of the discharges of accumulator towards the nozzle chamber, means which control the amounts of fuel discharged from the accumulator towards the nozzle chamber.

2. An internal combustion engine as defined in claim 1, characterized in that said means which prevents the discharge of the accumulator into high pressure channel include a one-way check valve.

3. An internal combustion engine as defined in claim 2, characterized in that said means which control the timing and the amount of fuel discharged from the accumulator towards the nozzle chamber include a 3-way electromagnetic valve electronically programmed, located on high pressure channel, and connected with the accumulator.

4. An internal combustion engine as defined in claim 3 characterized in that said means which control the amount of fuel discharged from the accumulator towards the nozzle chamber include a 2-way electromagnetic valve electronically programmed, located on the channel on which fuel flows into accumulator.

5. An internal combustion engine as defined in claim 3, characterized in that said means which control the amount of fuel discharged from the accumulator towards the nozzle chamber include a pressure control valve which controls a connection between the accumulator and said drain, said pressure control valve being actuated by the nozzle spring whose force acts in the sense of valve closing, said pressure control valve including a chamber in open connection with high pressure channel of the injector, the force generated on the valve by the fuel pressure in said chamber acting in the sense of valve closing, said pressure control valve being designed to remain closed during the injection of the portions of the fuel charge, and to open after the injection of the portions of the fuel charge, when the fuel pressure in high pressure channel has decreased, which allows the partial discharge of the accumulator into said drain.

6. An internal combustion engine as defined in claim 5, characterized in that the high pressure section of the injection system includes a valve which discharges this section into fuel tank between consecutive injections, to a predetermined pressure.

7. An internal combustion engine as defined in claim 5, characterized in that the high pressure section of the injection system is discharged into fuel tank between consecutive injections, to a predetermined pressure, the discharge being achieved through and controlled by the injection pump.

8. An internal combustion engine as defined in claim 3, characterized in that said injector includes a 2-way electromagnetic valve electronically programmed, located on the connection between the accumulator and said 3-way electromagnetic valve, the two electromagnetic valves of the injector controlling the timing and the amount of the accumulator discharges towards the nozzle chamber.

9. An internal combustion engine is defined in claim 2, characterized in that said high pressure channel includes a one-way check valve, the connection between the accumulator and the nozzle chamber being provided with two 2-way electromagnetic valves electronically programmed, which control the timing and the amount of the accumulator discharges towards the nozzle chamber.

10. An internal combustion engine as defined in claim 9, characterized in that said one-way check valve located on high pressure channel is substituted with a poppet valve provided with retraction piston.

11. An internal combustion engine as defined in claim 8, characterized in that the accumulator is provided with a pressure relief valve designed to open at a selected pressure.

* * * * *